United States Patent [19]

Burnell et al.

[11] Patent Number: 4,644,718

[45] Date of Patent: Feb. 24, 1987

[54] FOUNDATION ARRANGEMENT

[75] Inventors: Richard M. Burnell, Banbury; Donald Bridge, Chelmsford, both of England

[73] Assignee: Penguin Swimming Pools Limited, Chelmsford, England

[21] Appl. No.: 812,190

[22] Filed: Dec. 23, 1985

[30] Foreign Application Priority Data

Dec. 21, 1984 [GB] United Kingdom ..... 8432349
Jun. 4, 1985 [GB] United Kingdom ..... 8514038

[51] Int. Cl.[4] ..... E04G 11/48; E02D 27/00

[52] U.S. Cl. ..... 52/295; 52/741; 249/26; 249/33

[58] Field of Search ..... 52/258, 293, 607, 609, 52/259, 295, 741; 249/26, 33, 34, 13, 83, 91

[56] References Cited

U.S. PATENT DOCUMENTS

| | | | |
|---|---|---|---|
| 1,887,132 | 11/1932 | Houghton | 52/258 |
| 2,068,831 | 1/1937 | Washburn et al. | 52/358 |
| 2,891,397 | 6/1959 | Hauer | 52/607 |
| 3,759,043 | 9/1973 | Tokunaga | 52/609 |
| 4,186,160 | 1/1980 | Landreth | 52/293 |

FOREIGN PATENT DOCUMENTS

| | | | |
|---|---|---|---|
| 481920 | 3/1952 | Canada | 52/259 |
| 437358 | 7/1948 | Italy | 52/428 |

*Primary Examiner*—James L. Ridgill, Jr.
*Attorney, Agent, or Firm*—Thomas R. Vigil

[57] ABSTRACT

In order to provide a form of foundation on which light-weight shuttering may be erected prior to pouring the concrete into the foundation, there is provided a method of forming a foundation for an excavated construction, comprising excavating to a predetermined depth, arranging pre-formed footing elements 2 in a required configuration on the base of the excavation 1, the said footing elements 2 having upper surfaces with means for locating shuttering 3, 4 for walls to be erected on the foundation, the footing elements also being adapted to receive reinforcing bars 5, 5*a* for the foundation and/or the walls, and subsequently pouring a concrete mix into the excavation to bond substantially monolithically with the footing elements. The footing elements need considerable strength, and they are preferably pre-formed in an open construction of concrete or a light-weight aggregate. The invention further includes footing elements as set forth above, and foundations made by the method.

17 Claims, 8 Drawing Figures

FOUNDATION ARRANGEMENT

FIELD OF THE INVENTION

This invention relates to the construction of foundations for excavated constructions, such as swimming pools.

Although the invention is primarily intended for the purpose of constructing swimming pools and the like, it will be understood that the principals of construction are applicable to other forms of construction, including buildings to be cast in situ, with a foundation or concrete floor laid on an existing surface.

REVIEW OF THE PRIOR ART

The now expired United Kingdom patents GB-A No. 1038841, GB-A No. 1103981 and GB-A No. 1103511 described the use, in swimming pool construction, of shuttering elements comprising two slabs of cement joined together in spaced relationship by cast-in tie bars. The shuttering elements are assembled together to form permanent shuttering for the construction of monolithic concrete walls for swimming pools. This method of construction has been commercially very successful for a considerable number of years. However, the factory-formed shuttering elements are heavy to handle and also are expensive to transport as they are comparatively bulky, in view of the spacing between the slabs.

It is conventional in swimming pool and like construction to excavate for the pool and then to form a foundation for the floor and walls of the pool by pouring in a lean concrete mix, which has to set before the wall shuttering can be erected and the concrete for the walls poured in.

REFERENCE TO RELATED APPLICATION

Co-pending application Ser. No. 758302, entitled "Swimming Pool Construction" and filed on 21st Dec. 1984 and having a common Assignee with the present application, describes a method of constructing a wall for a swimming pool using shuttering components which are lighter and less bulky to transport than conventional components.

SUMMARY OF THE INVENTION

It is an object of the present invention to provide a form of foundation which is particularly suitable for use with such light-weight shuttering, and on which the shuttering may be erected prior to pouring the concrete into the foundation.

Although particularly designed for use with the shuttering and method forming the subject matter of the said co-pending application, the present foundation arrangements are not limited in their applicability to use with such shuttering and method, nor to use in the construction of swimming pools.

In accordance with a first aspect of the invention, there is provided a method of forming a foundation, comprising arranging pre-formed footing elements in a required configuration on a base for the construction, the said footing elements having upper surfaces with means for locating shuttering for walls to be erected on the foundation, the footing elements also being adapted to receive starter reinforcing bars for the foundation and/or the walls, locating starter reinforcing bars in the footing elements and securing reinforcing bars thereto, and subsequently pouring a concrete mix to bond substantially monolithically with the footing elements.

For forming a foundation for an excavated construction, such as a swimming pool or a spa pool, the method comprises excavating to a predetermined depth, and arranging the footing elements in a required configuration on the base of the excavation.

The footing elements may be laid on pads of a concrete mix.

It is preferred that the concrete mix is poured into the foundation after the shuttering for the walls has been erected. By this means, the construction procedure is speeded up, and the use of plant, such as concrete pumps, is made more economic. It may be possible to pour the concrete into the foundation and the shuttering in a single operation. In order for this to be practicable, the footing elements need considerable strength, and they are preferably pre-formed of concrete or a light-weight aggregate.

The footing elements are preferably of an open construction to enable the poured concrete to penetrate through and around them. In a particular embodiment of the method, the footing elements each have upper and lower horizontal frames linked by pillars. The upper frame is provided on its upper surface with recesses forming the said means for locating the shuttering, and each footing element may comprise a pair of spaced pillars, with the upper and lower frames arranged in a parallel relationship and each comprising a pair of arms each extending away from one of the pillars and converging, with their distal ends joined by a further arm extending generally parallel with a line joining the pillars.

In an alternative construction, the footing elements are each formed by a pair of upwardly open U-shaped frames which are spaced apart and joined by parallel top members, which are preferably of different lengths and which overhang beyond the frames on both sides. Recesses for the shuttering are formed in the upper surfaces of the top members. By this means, reinforcing bars or rods may be easily introduced through the open tops of the U-shaped frames.

Starter reinforcement elements are preferably laid on the bases of the U-shaped frames, such reinforcement elements comprising a pair of short bars spanning the said bases and secured to a vertical support, and in which a U-shaped reinforcing support element is introduced between the said short bars and the parallel top members of the frame to be held by its own resilience and to extend generally horizontally out of the footing element into the area to receive the concrete mix.

By this means, the zone of junction between the horizontal concrete forming the foundation and the vertical concrete forming the walls is considerably reinforced, so that the construction is inherently strengthened.

In accordance with a second aspect of the invention, there is provided a footing element particularly for use in a method according to the invention as set forth above, having upper surfaces with means for locating shuttering for walls to be erected on a plurality of footing elements, and also being adapted to receive reinforcing bars for the foundation and/or the walls, the footing element being in the form of upper and lower horizontal frames linked by pillars.

In accordance with a third aspect of the invention, there is provided a footing element particularly for use in a method according to the invention as set forth above, having upper surfaces with means for locating shuttering for walls to be erected on a plurality of footing elements, and also being adapted to receive reinforcing bars for the foundation and/or the walls, the footing element being in the form of a pair of upwardly open U-shaped frames which are spaced apart and joined by parallel top members, which are preferably of different lengths and which overhang beyond the frames on both sides.

Recesses for the shuttering may be formed in the upper surfaces of the top members.

The invention further comprises a foundation, particularly for an excavated construction, formed by a method in accordance with the invention as set forth above, and a swimming pool having such a foundation.

BRIEF DESCRIPTION OF THE DRAWINGS

The invention will be further described with reference to the accompanying diagrammatic drawings, in which.

DETAILED DESCRIPTION OF PARTICULAR EMBODIMENTS

Figure 1:
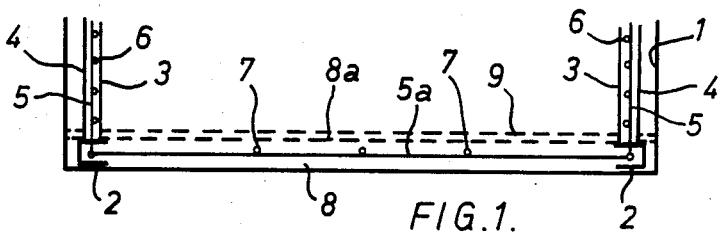
FIG. 1 is a sectional view of a swimming pool having a foundation in accordance with one form of the invention in course of construction.

Turning first to FIG. 1, this shows in diagrammatic form an excavation 1 for a swimming pool. Footing elements in the form of open blocks 2, to be described more in detail hereinafter, are arranged along the line of the desired wall of the pool in the bottom of the excavation, and preferably set in small pads of a concrete mix to hold them in position during assembly. Shuttering, consisting of an inner skin 3 and an outer skin 4, is laid on the footing blocks 2, and starter reinforcing bars 5 and 5*a* are laid in vertical and horizontal positions as required. Further reinforcing bars, such as those indicated at 6 and 7 are laid on or attached to the starter bars 5 and 5*a*, until the required reinforcing mesh is built up. Preformed mesh may be suitably introduced if required.

A foundation layer of concrete, as illustrated at 8, is then poured to a level indicated by the dotted line 8*a*, substantially flush with the upper surface of the footing elements 2.

The concrete may then be poured between the shuttering formed by the skins 3 and 4 to form the wall of the swimming pool. If the footing elements 2 are strong enough and set sufficiently firmly, this concrete may be poured before the foundation layer 8 is set, so that there is little delay in the construction work.

Once the walls have set, and the parts of the shuttering which are to be removed have been removed, then a finishing screed, indicated at 9, may be added to the foundation layer 8. The foundation is then ready for its final tiling, or whatever alternative surface finish is to be applied.

The shuttering employed for the inner and outer skins 3 and 4 may be as described in the above-mentioned co-pending application, the contents of which are imported herein by reference.

Figure 2:
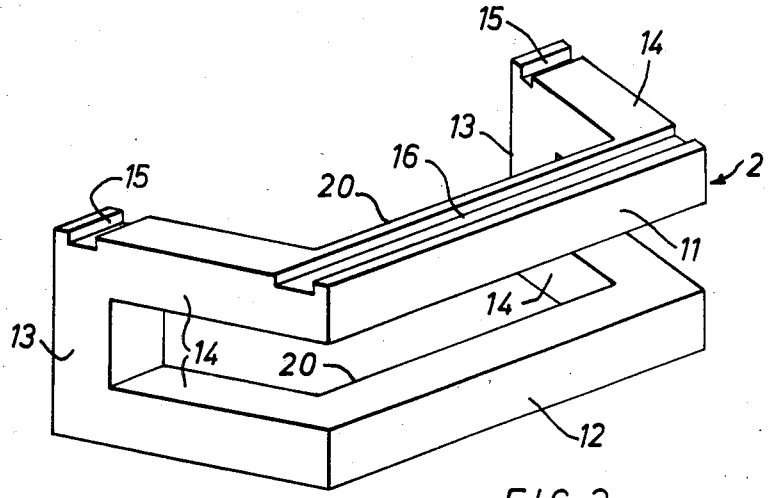
FIG. 2 is a perspective view of one footing element in accordance with a preferred form of the invention.

Turning now to FIG. 2, there is shown one of the footing elements 2 of the type shown diagrammatically in FIG. 1. It will be seen that this footing element is of an open construction to enable the starter bars 5 and 5*a* to be assembled within the volume circumscribed by the footing element 2, and also to enable the element 2 to integrate substantially monolithically with the poured concrete.

The footing elements or blocks 2 are preferably preformed, preferably of concrete or a light-weight aggregate, to give them sufficient structural strength to support the comparatively light-weight shuttering and the wall aggregate poured within the shuttering.

In the construction illustrated in FIG. 2, the element 2 consists of an upper frame 11 and a lower frame 12. Each of these frames is of truncated V-shape, and the two frames 11 and 12 are joined by a pair of integral pillars 13. An arm 20 forming a base of each of the frames 11 and 12 is substantially parallel with a line joining the pillars 13, and the frames are completed by a pair of arms 14 which converge away from the pillars 13, so that the arm 20 joining them at their distal ends is shorter than the space in between the pillars 13. As an example, the overall width across the outside of the pillars 13 may be 2 feet (60 cm), while the overall width across the outside of the ends of the arms 14 may be 1 foot 6 inches (45 cm). The height may be approximately 9 inches (23 cm) and the depth may be 10 inches (25 cm).

The upper surface of the upper frame 11 is formed with grooves or recesses 15, at the tops of the pillars 13, and 16 along the upper arm 20 to locate the shuttering 3 and 4. The grooves 15 and 16 are of substantial width, e.g. ½ inch (1.25 cm) so as to accommodate the shuttering with some play to enable the formation of arcuate walls.

Figure 3:
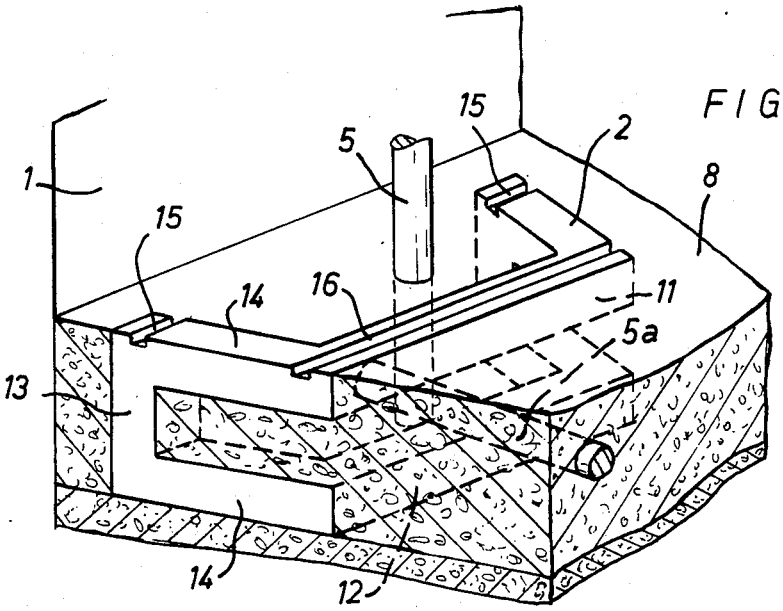
FIG. 3 is a view similar to FIG. 2 and showing reinforcing bars.

FIG. 3 shows the footing element 2 of FIG. 2 in conjunction with starter bars or mesh 5 and 5*a* and a concrete layer 8, although the shuttering and walls of the pool have been omitted from this Figure.

Figure 4:
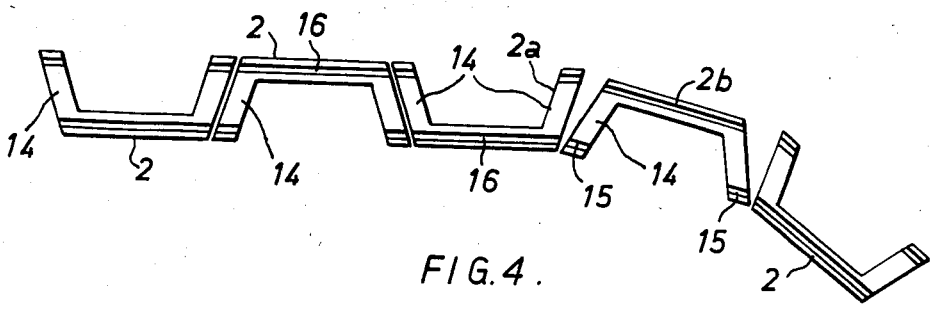
FIG. 4 is a plan view showing arrangements of footing elements to form straight and arcuate lengths of wall.

FIG. 4 is a plan view showing how adjacent footing blocks 2 may be arranged so as to taper alternately to enable formation of a straight line footing. If an arcuate formation is desired, the footing blocks 2 may be arranged so that their adjacent arms 14 are not strictly parallel, as indicated for the footing blocks 2*a* and 2*b*. It is also possible to form a radiused line by arranging adjacent footing blocks 2 so that they diverge and converge in the same direction rather than alternately as for the straight line arrangement.

Figure 5:
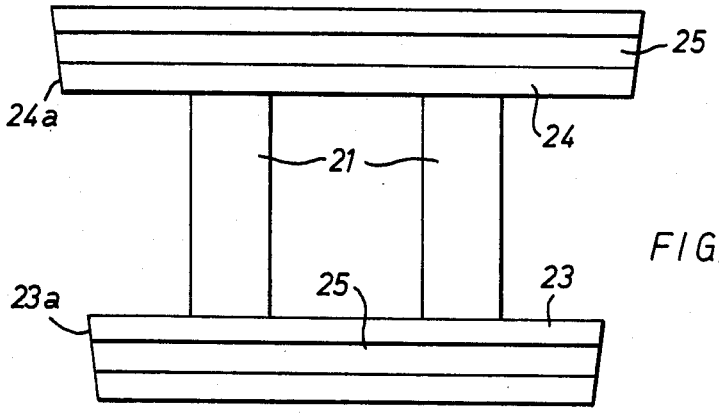
FIG. 5 is a plan view of an alternative and presently preferred form of footing element
Figure 6:
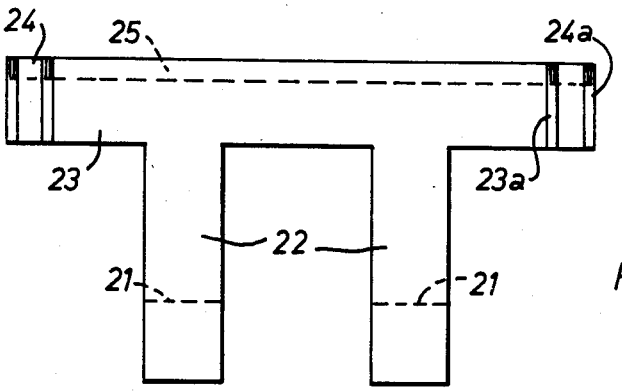
FIG. 6 is a side elevation of the element of FIG. 5.
Figure 7:
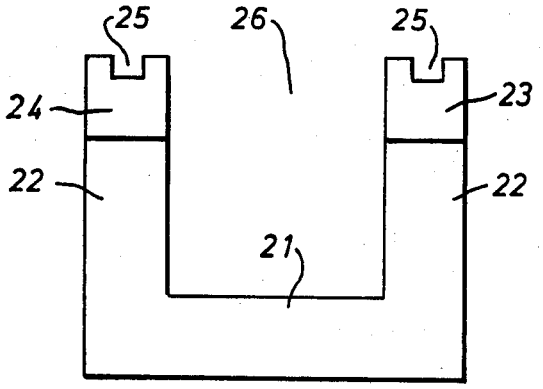
FIG. 7 is an end elevation thereof.

In the alternative form of footing block shown in FIGS. 5 to 7, each block comprises a pair of upwardly open U-shaped frames, comprising a flat base 21 and two pillars 22. The frames are spaced apart and joined by parallel top members 23 and 24, which are of different lengths, with the top member 24 being longer than the top member 23. Both top members 23 and 24 overhang beyond the frames on both sides, so as to allow free flow of poured concrete to assist in monolithic bonding. The top members 23 and 24 have inclined ends 23*a* and 24*a*. Recesses 25 for the shuttering are formed in the upper surfaces of the top members 23 and 24. By using such a construction of footing element, reinforcing bars or rods may be easily introduced through the open tops 26 of the U-shaped frames.

By way of example, the frames may be about 11 inches (28 cm) from front to back, and precast in $2\frac{1}{2}$ inches (6.5 cm) thick aggregate, leaving 6 inches (15 cm) of free space between the pillars 22 of each frame. The long top member 24 may be 17 inches (43 cm) long, while the shorter top member 23 may be $14\frac{1}{4}$ inches (36 cm) long. The height may be 9 inches (23 cm).

Figure 8:
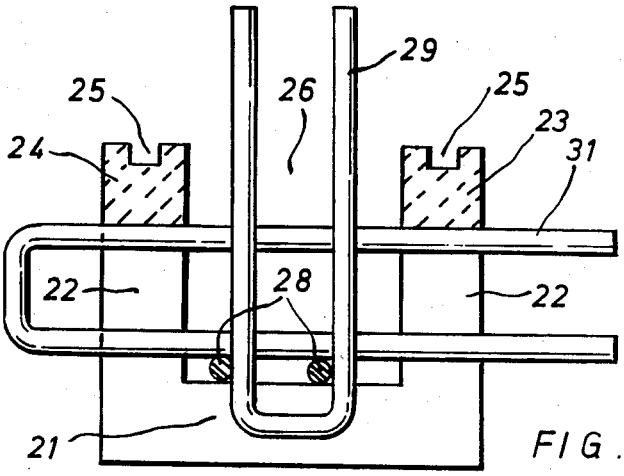
FIG. 8 is a view similar to FIG. 7, and showing starter reinforcement elements.

FIG. 8 shows starter reinforcement added to the block shown in FIG. 7. A composite starter element comprises a pair of parallel short bars 28 long enough to span the gap between the bases 21 of the footing block or that between the adjacent bases 21 of adjacent blocks. Welded to the bars 28 is a U-shaped vertical starter bar 29. A U-shaped horizontal starter bar 31 is then introduced into the space between the short bars 29 and the top members 23 and 24. The starter bar 31 is then turned into a vertical plane and is dimensioned so that it is held by its resilience in a stable position. The use of this configuration of short horizontal bars 28 and U-shaped starter bars 29 and 31 provides exceptionally good reinforcement of the junction zone between the wall and the foundation, leading to a substantially monolithic construction.

Various other modifications may be made within the scope of the invention.

We claim:

1. A footing element for use in the formation of a foundation layer, the said footing element having upper surfaces with means for locating shuttering for walls to be erected on a plurality of footing elements, and also being adapted to receive reinforcing bars for the foundation layer and the walls, the footing element being in the form of a pair of upwardly open U-shaped frames which are spaced apart and joined by parallel top members.

2. A footing element as claimed in claim 1, in which the parallel top members are of different lengths.

3. A footing element as claimed in claim 1, in which the parallel top members overhang beyond the frames on both sides.

4. A footing element as claimed in claim 1, in which recesses for the shuttering are formed in the upper surfaces of the top members.

5. In a method of forming a foundation layer for a reinforced concrete construction: the improvement that the method comprises the steps of p1 (a) arranging pre-formed open-section footing elements in a required configuration on a base for the construction, the said footing elements having upper surfaces with means for locating shuttering for walls to be erected on the foundation layer, the footing elements also being adapted to receive starter reinforcing bars for the foundation layer and the walls, (b) locating starter reinforcing bars in the footing elements (c) securing reinforcing bars for the foundation layer and the walls to the said starter bars, and (d) subsequently pouring a concrete mix to penetrate through and around the footing elements and to bond the reinforcing bars substantially monolithically with the footing elements to form a generally horizontal reinforced concrete foundation layer.

6. A method as claimed in claim 5, for forming an excavated construction, comprising excavating to a predetermined depth, in which the footing elements are placed on the base of the excavation.

7. A method as claimed in claim 5, in which the footing elements are set on pads of a concrete mix.

8. A method as claimed in claim 5, in which the concrete mix is poured to form the foundation layer after the shuttering for the walls has been erected.

9. A method as claimed in claim 5, in which the footing elements each have upper and lower horizontal frames linked by pillars.

10. A method as claimed in claim 9, in which the upper frame is provided on its upper surface with recesses forming the said means for locating the shuttering.

11. A method as claimed in claim 9, in which each of the footing elements comprises a pair of spaced pillars, and in which the upper and lower frames are arranged in a parallel relationship and each comprise a pair of arms each extending away from one of the pillars and converging, with their distal ends joined by a further arm extending generally parallel with a line joining the pillars.

12. A method as claimed in claim 5, in which the footing elements are pre-formed of concrete or a lightweight aggregate.

13. A method as claimed in claim 12, in which the footing elements are each formed by a pair of upwardly open U-shaped frames which are spaced apart and joined by parallel top members.

14. A method as claimed in claim 13, in which the parallel top members are of different lengths.

15. A method as claimed in claim 13, in which the parallel top members overhang beyond the frames on both sides.

16. A method as claimed in claim 13, in which recesses for the shuttering are formed in the upper surfaces of the top members.

17. A method as claimed in claim 13, in which starter reinforcement elements are laid on the bases of U-shaped frames, such reinforcement elements comprising a pair of short bars spanning the said bases and secured to a vertical support, and in which a U-shaped reinforcing support element is introduced between the said short bars and the parallel top members of the frame to be held by its own resilience and to extend generally horizontally out of the footing element into the area to receive the concrete mix.

* * * * *

UNITED STATES PATENT AND TRADEMARK OFFICE

CERTIFICATE OF CORRECTION

PATENT NO. : 4,644,718

DATED : February 24, 1987

INVENTOR(S) : Richard M. Burnell et al.

It is certified that error appears in the above-identified patent and that said Letters Patent is hereby corrected as shown below:

Column 5, Line 51 - omit "pl" before (a)

Signed and Sealed this

Eighteenth Day of August, 1987

*Attest:*

*Attesting Officer*

DONALD J. QUIGG

*Commissioner of Patents and Trademarks*